US011424600B1

(12) United States Patent
Gozawa et al.

(10) Patent No.: US 11,424,600 B1
(45) Date of Patent: Aug. 23, 2022

(54) SPARK PLUG

(71) Applicant: NGK Spark Plug Co., Ltd., Nagoya (JP)

(72) Inventors: Tatsuya Gozawa, Nagoya (JP); Shunsuke Maeda, Nagoya (JP); Daiki Goto, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 17/668,796

(22) Filed: Feb. 10, 2022

(30) Foreign Application Priority Data

Mar. 9, 2021 (JP) ..... JP2021-037718

(51) Int. Cl.

| | |
|---|---|
| ***H01T 13/54*** | (2006.01) |
| ***H01T 21/02*** | (2006.01) |
| ***H01T 13/06*** | (2006.01) |
| ***H01T 13/16*** | (2006.01) |

(52) U.S. Cl.
CPC ..... *H01T 13/54* (2013.01); *H01T 13/06* (2013.01); *H01T 13/16* (2013.01); *H01T 21/02* (2013.01)

(58) Field of Classification Search
CPC ..... H01T 13/54
USPC ..... 313/141
See application file for complete search history.

(56) References Cited

U.S. PATENT DOCUMENTS

| | | | | |
|---|---|---|---|---|
| 11,174,778 | B2 * | 11/2021 | Nomura | F02M 21/0248 |
| 2016/0053671 | A1 * | 2/2016 | Sotiropoulou | F02B 19/1014 123/260 |
| 2018/0266307 | A1 * | 9/2018 | Muto | F02B 19/08 |
| 2019/0048784 | A1 * | 2/2019 | Ashizawa | F02B 19/1023 |
| 2020/0165960 | A1 * | 5/2020 | Takada | H01T 13/54 |

FOREIGN PATENT DOCUMENTS

| | | | |
|---|---|---|---|
| JP | 2020-159355 | A | 10/2020 |
| JP | 2021077605 | A * | 5/2021 |
| WO | WO-2022050123 | A1 * | 3/2022 |

* cited by examiner

*Primary Examiner* — Christopher M Raabe
(74) *Attorney, Agent, or Firm* — Kusner & Jaffe

(57) ABSTRACT

A spark plug includes a tubular metal shell; an insulator including a locking portion locked onto the metal shell; and a cap disposed at a front end side of the metal shell, the cap having a plurality of orifices. The plurality of orifices include orifices with different cross-sectional areas. A sum of the number of one or more largest orifices and the number of one or more large orifices that have a cross-sectional area of larger than or equal to 90% of the one or more largest orifices is smaller than the number of orifices that are other than the one or more largest orifices and the one or more large orifices. A length of the front end portion in an axial direction between a front end of the insulator and a front end of the locking portion is smaller than or equal to 12 mm.

5 Claims, 5 Drawing Sheets

SPARK PLUG

FIELD OF THE INVENTION

The present invention relates to a spark plug including a metal shell and a cap disposed at the front end of the metal shell.

BACKGROUND OF THE INVENTION

A spark plug including an insulator, a tubular metal shell surrounding the outer periphery of the insulator, and a cap disposed at the front end of the metal shell and having multiple orifices extending through the cap in a thickness direction is known (see Japanese Unexamined Patent Application Publication No. 2020-159355). This type of spark plug ignites fuel gas flowing into the cap through the orifices to generate a flame, and injects a gas flow including a flame into a combustion chamber through the orifices to burn the fuel gas in the combustion chamber with the injected flow.

In existing technologies, when the temperature inside the cap rises and the insulator is excessively heated, the fuel gas that has flowed into the cap through the orifices can be a spark causing pre-ignition.

SUMMARY OF THE INVENTION

The present invention is made to address the abovementioned problem, and an object of the present invention is to provide a spark plug that can reduce pre-ignition of fuel gas that has flowed into a cap.

A spark plug of the present invention made to achieve this object includes a tubular metal shell including, on an inner periphery, a ledge protruding inward in a radial direction; an insulator including a locking portion having a front end side locked onto the ledge directly or with another member interposed therebetween, and a front end portion adjacent to the front end side of the locking portion, the insulator extending along an axial line; and a cap disposed at a front end side of the metal shell to cover a front end side of the front end portion of the insulator, the cap having a plurality of orifices extending through the cap in a thickness direction of the cap. The plurality of orifices include orifices with different minimum cross-sectional areas. A sum of the number of one or more largest orifices that are included in the plurality of orifices and that have a largest minimum cross-sectional area and the number of one or more large orifices that are included in the plurality of orifices and that have a minimum cross-sectional area of larger than or equal to 90% of the minimum cross-sectional area of the one or more largest orifices is smaller than the number of orifices that are included in the plurality of orifices and that are other than the one or more largest orifices and the one or more large orifices. A length of the front end portion in an axial direction between a front end of the insulator and a front end of the locking portion is smaller than or equal to 12 mm.

According to a first aspect, the front end portion of the insulator has a length in the axial direction of smaller than or equal to 12 mm. Thus, the surface area of the front end portion of the insulator that is heated can be reduced. The cap has orifices with different minimum cross-sectional areas. This structure can thus vary the flow rate of fuel gas that has flowed into the cap through the orifices. The multiple flows with different flow rates enhance the fluidity of the fuel gas, and the fuel gas can cool the front end portion of the insulator. This structure can thus reduce overheating of the front end portion, and reduce pre-ignition.

The sum of the number of one or more largest orifices and the number of large orifices is smaller than the number of orifices other than the maximum and large orifices. This structure can thus inject a gas flow including a flame through the orifices other than the maximum and large orifices. This structure can thus stably ignite fuel gas in a combustion chamber, and improve the combustion stability.

According to a second aspect, the multiple orifices each have a minimum cross-sectional area that is larger than or equal to 90% of a maximum cross-sectional area of each orifice. This structure can reduce an energy loss of the injected flow resulting from a variance of the cross-sectional area of each orifice, and can thus further improve combustion stability in addition to the effect of the first aspect.

According to a third aspect, the minimum cross-sectional area of the one or more largest orifices is within a range from larger than or equal to 120% and smaller than or equal to 500% of the minimum cross-sectional area of a smallest orifice of the multiple orifices having a smallest minimum cross-sectional area. The flow of fuel gas improves the ignition stability, and also secures injection of a gas flow through the orifices other than the one or more largest orifices. This structure can thus further improve combustion stability in addition to the effect of the first or second aspect.

According to a fourth aspect, the multiple orifices are formed in an area of the cap excluding a portion that the axial line crosses. This structure can improve the fluidity of fuel gas inside the cap. This structure can thus enhance the performance of fuel gas of cooling the front end portion of the insulator, and further reduce pre-ignition in addition to the effect of any of the first to third aspects.

According to a fifth aspect, in a projection obtained by projecting the cap on a plane perpendicular to the axial line, when straight lines equal in number to the orifices are drawn at equal angles through an intersection point of the projection and the axial line, all the orifices cross the straight lines. This structure can substantially equalize heat transfer resulting from passage of the fuel gas or injected flow through the orifices around the axial line of the cap, and can thus substantially equalize the heat load around the axial line of the cap. This structure can thus further improve the combustion stability in addition to the effect of the fourth aspect.

DETAILED DESCRIPTION OF THE INVENTION

Figure 1:
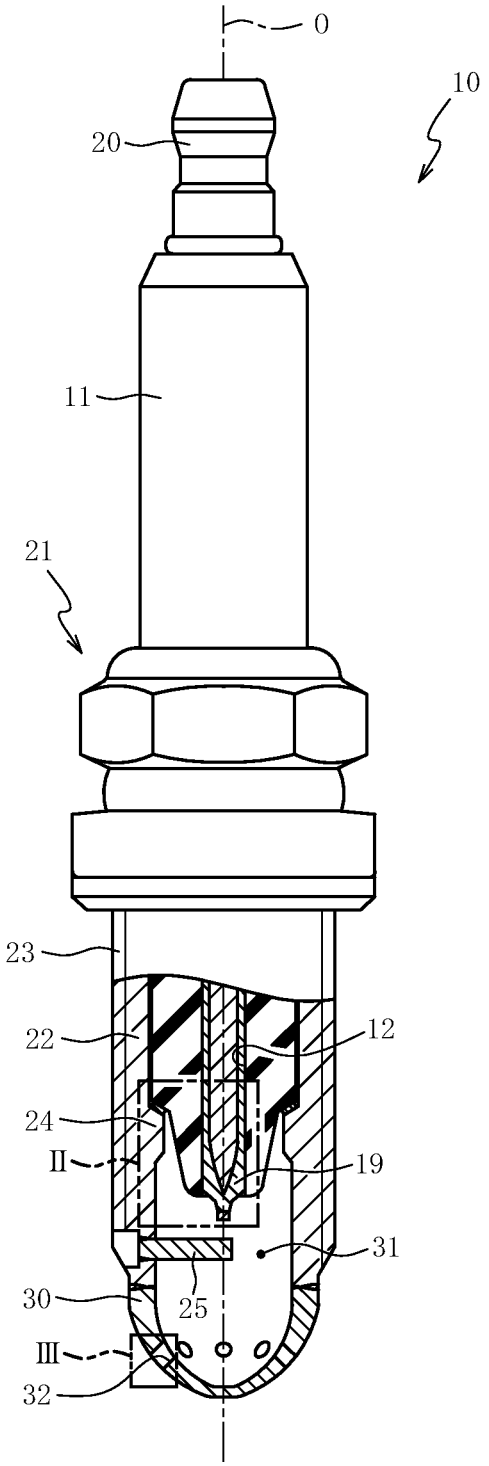
FIG. 1 is a partial cross-sectional view of a spark plug according to an embodiment.
Figure 2:
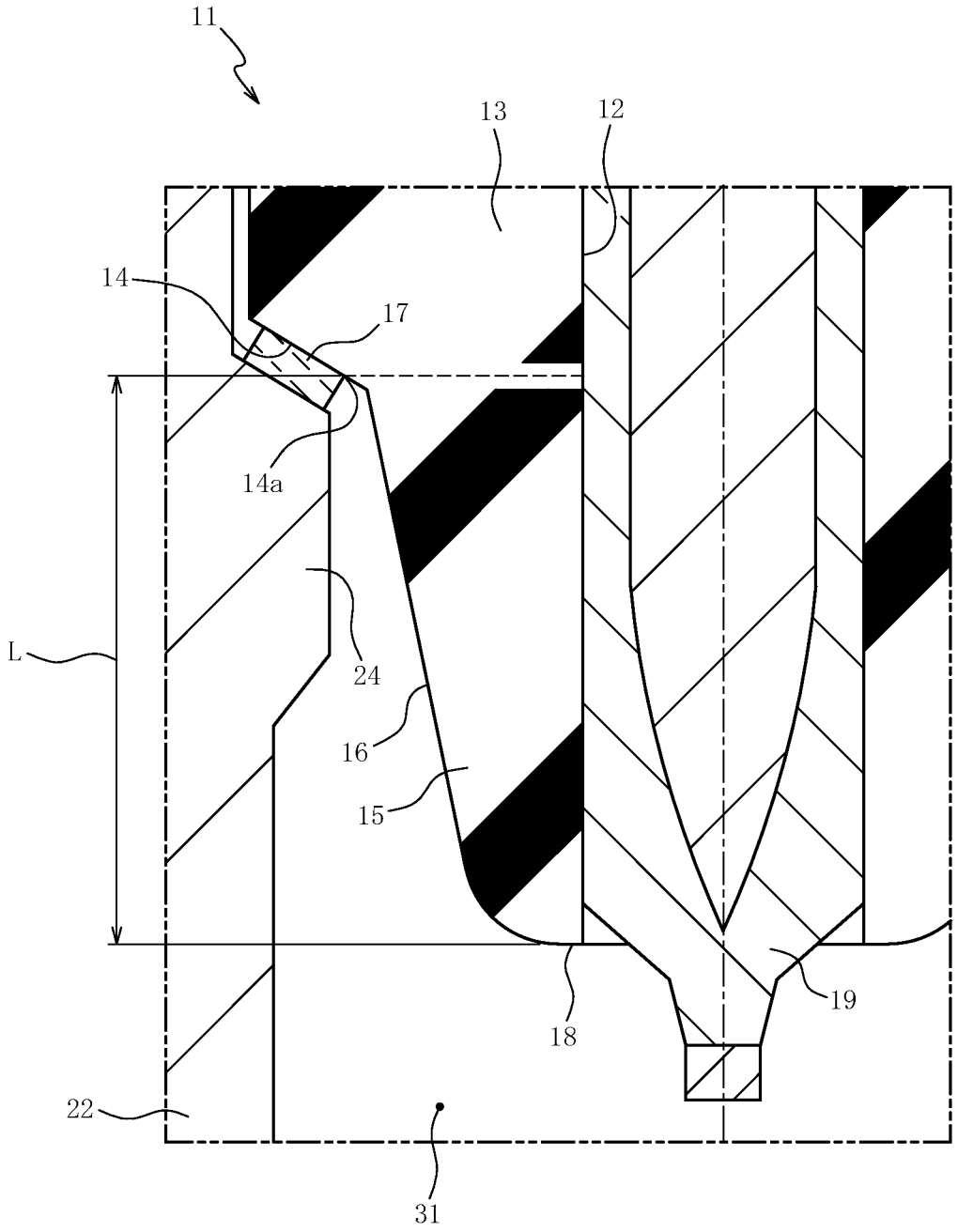
FIG. 2 is an enlarged cross-sectional view of a portion of the spark plug indicated with II in FIG. 1.

Preferable embodiments of the present invention will be described below with reference to the attached drawings. FIG. 1 is a partial cross-sectional view of a spark plug 10 according to an embodiment. FIG. 1 illustrates a cross section of a front end portion of the spark plug 10 taken to include an axial line O. FIG. 2 is an enlarged cross-sectional view of a portion of the spark plug 10 indicated with II in FIG. 1 taken to include the axial line O. In FIGS. 1 and 2, the lower side in the drawing is referred to as a front end side of the spark plug 10, and the upper side in the drawing is referred to as a rear end side of the spark plug 10.

As illustrated in FIG. 1, the spark plug 10 includes an insulator 11, a metal shell 21, and a cap 30. The insulator 11 is a substantially cylindrical member having an axial hole 12 extending along the axial line O, and formed from ceramics such as alumina having high mechanical characteristics and high insulating properties under high temperatures.

As illustrated in FIG. 2, the insulator 11 includes a locking portion 13, and a front end portion 15 adjacent to the front end side of the locking portion 13. The outer diameter of the front end portion 15 is smaller than the outer diameter of the locking portion 13. The locking portion 13 has a locking surface 14 facing toward the front end. In the present embodiment, the locking surface 14 is a conical surface that tapers toward the front end, but is not limited to this. The locking surface 14 may be a surface perpendicular to the axial line O. The front end portion 15 has an outer peripheral surface 16 facing outward in the radial direction. The outer peripheral surface 16 is adjacent to the front end side of the locking surface 14.

A packing 17 is in contact with a portion of the insulator 11 including a boundary 14*a* (front end of the locking portion 13) between the locking portion 13 and the front end portion 15, and located closer to a rear end beyond the boundary 14*a*. The packing 17 is an annual plate formed from a metal such as iron or steel softer than a metal forming the metal shell 21. In the present embodiment, the packing 17 is in contact with only the locking surface 14, but is not limited to this. The packing 17 may be in contact with an area extending across the locking surface 14 and the outer peripheral surface 16.

The front end portion 15 is a portion of the insulator 11 located closer to the front end than a portion with which the packing 17 is in contact. A length L of the front end portion 15 in the axial direction refers to a distance in the axial direction between the boundary 14*a* and a front end 18 of the insulator 11. When a cross section taken to include the axial line O is observed, the boundary 14*a* and the front end 18 of the insulator 11 appear on both sides of the axial line O. At least one of two distances, on both sides of the axial line O, between the front end 18 of the insulator 11 and the boundary 14*a* is smaller than or equal to 12 mm.

Description will be made with reference to FIG. 1 again. A center electrode 19 is disposed in the axial hole 12 of the insulator 11 at the front end side. The tip end of the center electrode 19 protrudes toward the front end from the insulator 11. The center electrode 19 is electrically connected to a metal terminal 20 inside the axial hole 12. The metal terminal 20 is a stick-shaped member to which a high-voltage cable (not illustrated) is connected, and formed from an electrically conductive metal (such as low-carbon steel). The metal terminal 20 is fixed to a rear end of the insulator 11.

The metal shell 21 is a substantially cylindrical member formed from an electrically conductive metal (such as low-carbon steel). The metal shell 21 surrounds the outer periphery of the insulator 11. An external thread 23 is formed on the outer periphery of a trunk portion 22 of the metal shell 21. The external thread 23 is fitted into a threaded hole (not illustrated) of an engine. In the present embodiment, the nominal diameter of the external thread 23 is smaller than or equal to 14 mm. The outer diameter of the front end portion 15 of the insulator 11, that is, the surface area of the front end portion 15 is substantially proportional to the nominal diameter of the external thread 23. Normally, the outer diameter of the front end portion 15 is substantially half the nominal diameter of the external thread 23.

As illustrated in FIG. 2, a ledge 24 is disposed on the inner periphery of the trunk portion 22 of the metal shell 21. The ledge 24 is located on the front end side of the locking surface 14 of the insulator 11. The ledge 24 allows the locking portion 13 of the insulator 11 to be locked thereon. In the present embodiment, the packing 17 is interposed between the locking portion 13 and the ledge 24. The metal shell 21 supports the center electrode 19 with the insulator 11 interposed therebetween. The outer peripheral surface 16 of the front end portion 15 of the insulator 11 is in contact with neither the packing 17 nor the metal shell 21.

Description will be made with reference to FIG. 1 again. A ground electrode 25 is disposed on the trunk portion 22 of the metal shell 21. The ground electrode 25 is a metal stick-shaped member formed from at least one of materials including Pt, Ni, and Ir as a main component. In the present embodiment, the ground electrode 25 is located at the external thread 23, and extends through the trunk portion 22. Part of the ground electrode 25 faces the center electrode 19, and a spark gap is left between the center electrode 19 and the ground electrode 25.

The cap 30 is connected to the trunk portion 22 of the metal shell 21. The cap 30 is a hemispherical member. Examples of the material of the cap 30 include at least one metal material including Fe, Ni, and Cu as a main component. In the present embodiment, the cap 30 is welded to the metal shell 21. The cap 30 covers the front end side of the front end portion 15 of the insulator 11 (refer to FIG. 2), and defines a pre-chamber 31 with the trunk portion 22 of the metal shell 21.

The outer peripheral surface 16 of the front end portion 15 of the insulator 11 (refer to FIG. 2) is exposed to the pre-chamber 31. The cap 30 has multiple orifices 32 that extend through the cap 30 in the thickness direction. The orifices 32 connect the pre-chamber 31 and a combustion chamber of an engine (not illustrated).

In response to an operation on the valve of an engine (not illustrated), fuel gas flows into the pre-chamber 31 of the spark plug 10 attached to the engine from the combustion chamber of the engine through the orifices 32. The spark plug 10 generates a flame kernel with discharge between the center electrode 19 and the ground electrode 25. When the flame kernel grows, the fuel gas in the pre-chamber 31 ignites and burns. The expansion pressure resulting from combustion of the fuel gas causes a gas flow including a flame, and injects gas including a flame into the combustion chamber through the orifices 32. The injected flow of the flame burns the fuel gas in the combustion chamber.

The combustion of the fuel gas in the pre-chamber 31, injection of the gas flow including a flame, and the combustion of the fuel gas in the combustion chamber heat the insulator 11, the center electrode 19, the trunk portion 22 of the metal shell 21, and the cap 30. The fuel gas that has flowed into the combustion chamber or the pre-chamber 31 in response to the operation on the valve of the engine cools the insulator 11, the center electrode 19, the trunk portion 22 of the metal shell 21, and the cap 30. Heat of the trunk portion 22 of the metal shell 21, the ground electrode 25, and the cap 30 transfers to the engine through the external thread 23. Heat of the center electrode 19 and the insulator 11 transfers from the packing 17 (refer to FIG. 2) to the engine through the external thread 23.

Figure 3:
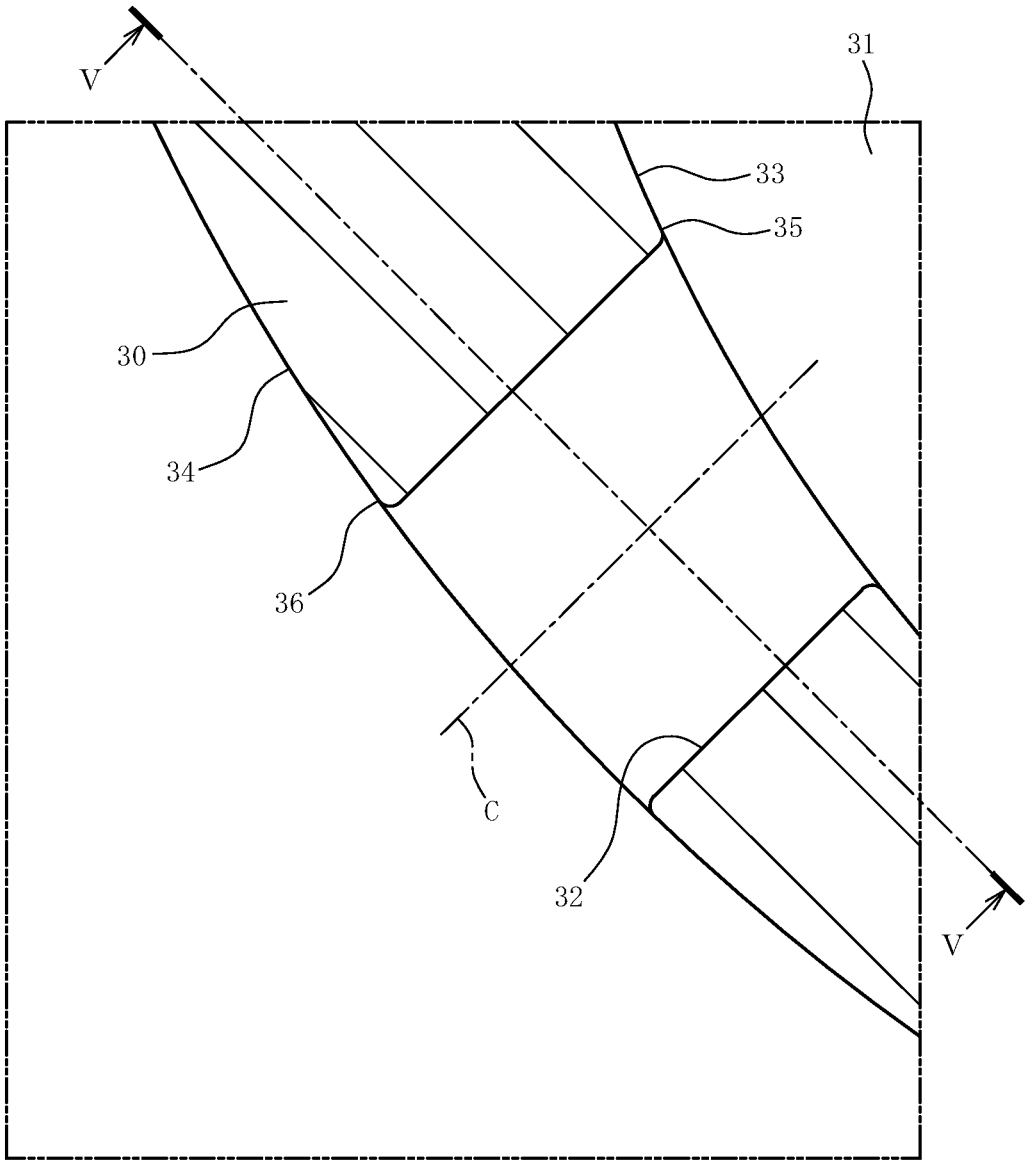
FIG. 3 is an enlarged cross-sectional view of a portion of a cap indicated with III in FIG. 1.

FIG. 3 is an enlarged cross-sectional view of a portion of the cap 30 indicated with III in FIG. 1. The orifice 32 extends through the cap 30 from an inner surface 33 to an outer surface 34 of the cap 30. The orifice 32 has a circular cross section taken perpendicular to the center line C of the orifice 32.

An edge 35 of the orifice 32 where the inner surface 33 of the cap 30 and the orifice 32 cross is chamfered or rounded. An edge 36 of the orifice 32 where the outer surface 34 of the cap 30 and the orifice 32 cross is also chamfered or rounded. Thus, the cross-sectional area of the orifice 32 taken perpendicular to the center line C of the orifice 32 at a portion near the edge 35 or 36 is larger than the cross-sectional area of the orifice 32 taken perpendicular to the center line C of the orifice 32 at a portion away from the edge 35 or 36. To avoid the effect of chamfering or rounding of the edge 35 or 36, the cross-sectional area of each orifice 32 refers to a cross-sectional area of each orifice 32 taken perpendicular to the center line C at a position larger than or equal to 0.2 mm away from the edge 35 or 36 along the center line C.

A minimum cross-sectional area of each orifice 32 obtained when the cross-sectional area of the orifice 32 is measured at any position within a range larger than or equal to 0.2 mm away from the edge 35 or 36 along the center line C is larger than or equal to 90% of a maximum cross-sectional area of the orifice 32 within this range. This is determined to reduce energy loss of the injected flow resulting from a variance of the cross-sectional area of the orifice 32.

Figure 4:
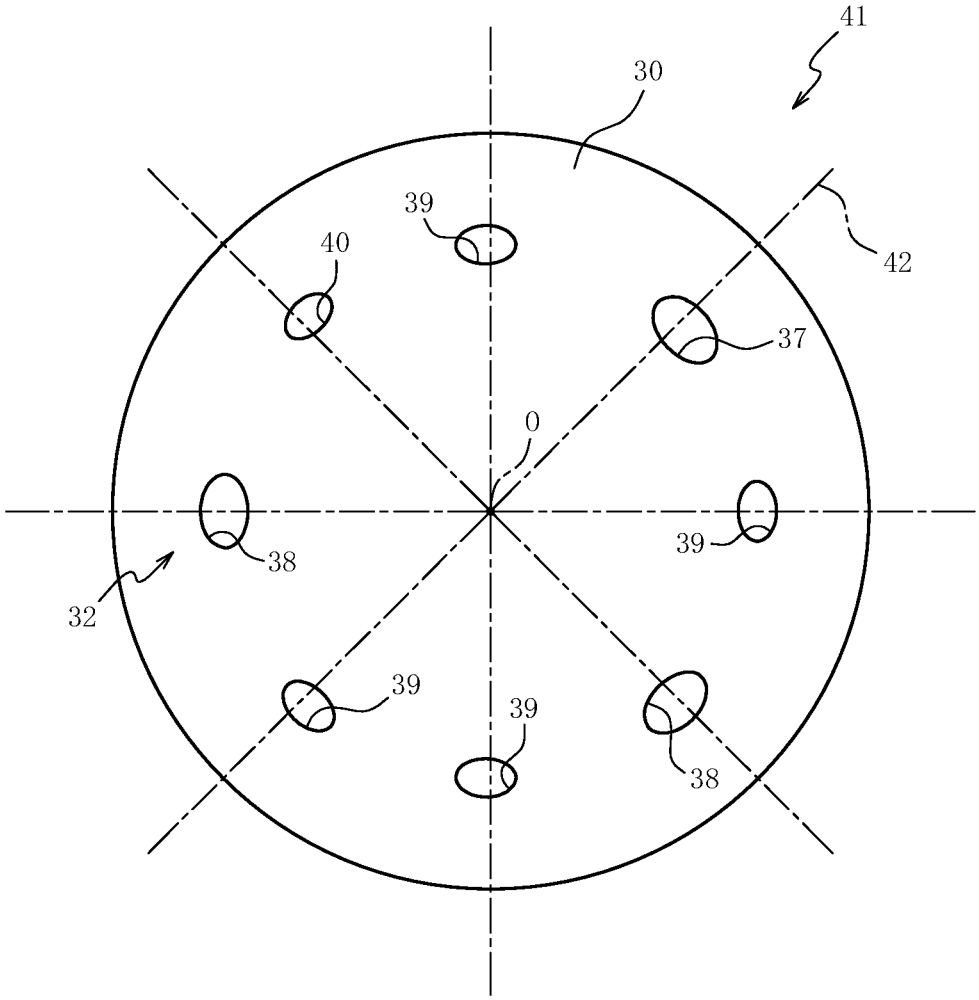
FIG. 4 is a projection obtained by projecting the cap on a plane perpendicular to the axial line.

FIG. 4 is a projection 41 obtained by projecting the cap 30 on the plane perpendicular to the axial line O. The orifices 32 are formed in an area of the hemispherical cap 30 excluding a portion that the axial line O crosses, and thus the orifices 32 that appear in the projection 41 are elliptical. The orifices 32 are formed in the area of the cap 30 excluding a portion that the axial line O crosses. Thus, the flow of fuel gas that has flowed into the pre-chamber 31 from the combustion chamber through the orifices 32 can form a large swirl. This structure can improve the fluidity of fuel gas in the pre-chamber 31, enhance the performance of fuel gas of cooling the front end portion 15 of the insulator 11, and further reduce pre-ignition.

The orifices 32 include a largest orifice 37, large orifices 38, small orifices 39, and a smallest orifice 40. In the present embodiment, the cap 30 has eight orifices 32. The eight orifices 32 are located at substantially the same distance from the axial line O.

The orifices 32 in the cap 30 are arranged substantially equidistant from each other around the axial line O. Thus, in the projection 41, when straight lines 42 equal in number to the orifices 32 are drawn at equal angles through the intersection point of the projection 41 and the axial line O, the straight lines 42 can cross all the orifices 32. In the projection 41, each of the straight lines 42 does not have to cross the corresponding orifice 32 at the center of the orifice 32, but may cross the orifice 32 at any portion. This structure can substantially equalize heat transfer resulting from passage of the fuel gas or injected flow through the orifices 32 around the axial line of the cap 30, and can thus substantially equalize the heat load around the axial line of the cap 30. The present embodiment includes eight orifices 32, and thus the eight straight lines 42 are drawn. The smallest angle at which the straight lines 42 drawn at equal angles with respect to the axial line O cross each other is 45°.

Figure 5:
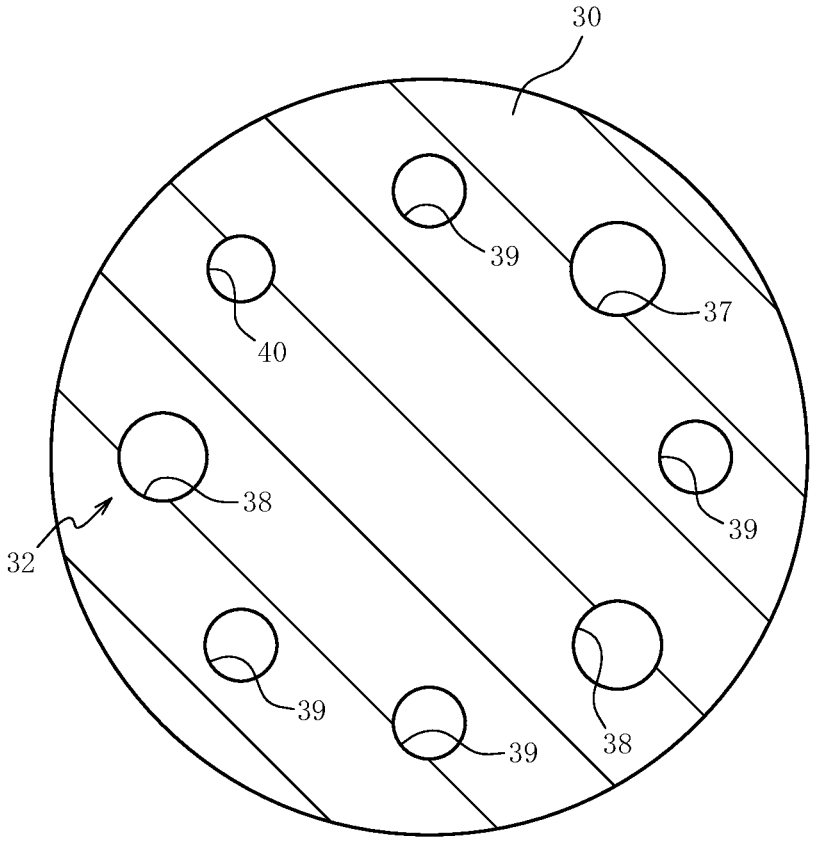
FIG. 5 is a schematic cross-sectional view of orifices in the cap taken along line V-V in FIG. 3.

FIG. 5 is a schematic cross-sectional view of the orifices 32 of the cap 30 taken along line V-V in FIG. 3. FIG. 5 collectively illustrates the cross sections of the orifices 32 taken perpendicular to the center lines C (refer to FIG. 3). The orifices 32 include the largest orifice 37, the large orifices 38, the small orifices 39, and the smallest orifice 40 with the different minimum cross-sectional areas. In FIG. 5, the orifices 32 with larger cross sections have larger minimum cross-sectional areas.

The largest orifice 37 is one of the orifices 32 with the largest minimum cross-sectional area. The present embodiment includes one largest orifice 37. The large orifices 38 are orifices with a minimum cross-sectional area of larger than or equal to 90% of the minimum cross-sectional area of the largest orifice 37. The present embodiment includes two large orifices 38. The small orifices 39 are orifices with a minimum cross-sectional area of smaller than 90% of the minimum cross-sectional area of the largest orifice 37. The smallest orifice 40 is one of the orifices 32 with the smallest minimum cross-sectional area. The smallest orifice 40 has a minimum cross-sectional area of smaller than 90% of the minimum cross-sectional area of the largest orifice 37.

The orifices 32 include orifices with different minimum cross-sectional areas, and thus can vary the flow rate of fuel gas that has flowed into the pre-chamber 31 of the cap 30 through the orifices 32. The multiple flows with different flow rates enhance the fluidity of fuel gas, and thus the front end portion 15 of the insulator 11 exposed to the pre-chamber 31 is cooled by combustion gas. The length L of the front end portion 15 in the axial direction is smaller than or equal to 12 mm, and thus the heat capacity of the front end portion 15 can be reduced. The combustion gas can enhance the effect of cooling the front end portion 15. Thus, pre-ignition of fuel gas that has flowed into the pre-chamber 31 through the orifices 32 can be reduced.

The sum of the number of one or more largest orifice 37 and the number of large orifices 38 (three in the present embodiment) is smaller than the sum of the number of small orifices 39 and the number of one or more smallest orifices 40 other than the largest orifice 37 and the large orifices 38 (five in the present embodiment). Thus, a gas flow including a flame can be also injected through the small orifices 39 and the smallest orifice 40 other than the largest orifice 37 and the large orifices 38. Thus, fuel gas in the combustion chamber can stably ignite, and combustion stability can be improved.

The minimum cross-sectional area of the largest orifice 37 is larger than or equal to 120% and smaller than or equal to 500% of the minimum cross-sectional area of the smallest orifice 40. The flow of fuel gas in the pre-chamber 31 is enhanced, and fresh fuel gas can more easily reach the spark gap. Thus, the ignition stability improves, the injection of a gas flow through the smallest orifice 40 can be secured, and combustion stability can be further improved.

EXAMPLES

The present invention will be described further in detail with the following example, but the present invention is not limited to this example.

(Sample Fabrication)

Similarly to the spark plug 10 according to an embodiment, a tester fabricated samples Nos. 1 to 11 as shown in Table 1. The samples Nos. 1 to 11 differ in length L (mm) of the front end portion 15 of the insulator 11, number obtained by subtracting "the sum of the number of one or more largest orifices 37 and the number of large orifices 38" from "the sum of the number of small orifices 39 and the number of one or more smallest orifices 40", rate (%) of the minimum cross-sectional area of the largest orifice 37 to the minimum cross-sectional area of the smallest orifice 40, and as to whether all the orifices 32 and the straight lines 42 cross each other in the projection 41. The samples Nos. 1 to 11 have the same quantity, dimensions, or shapes other than the above portions. The samples Nos. 1 to 11 each have eight orifices 32 in the cap 30, and the nominal diameter of the external thread 23 is 14 mm.

TABLE 1

| No. | Length of Front End Portion (mm) | Number of Orifices Including Small Orifices - Number of Orifices Including Large Orifices | Largest orifices/ Smallest orifices (%) | Crossing of Orifices and Straight Lines | Test 1 | Test 2 |
|---|---|---|---|---|---|---|
| 1 | 6 | Positive Number | 156 | Crossed | A | A |
| 2 | 12 | Positive Number | 156 | Crossed | A | A |
| 3 | 6 | Positive Number | 225 | Crossed | A | A |
| 4 | 6 | Positive Number | 400 | Crossed | A | A |
| 5 | 6 | Positive Number | 156 | Failed | A | B |
| 6 | 6 | Positive Number | 225 | Failed | A | B |
| 7 | 6 | Positive Number | 1600 | Failed | A | C |
| 8 | 6 | Positive Number | 115 | Failed | A | C |
| 9 | 6 | 0 | 115 | Failed | A | D |
| 10 | 15 | Positive Number | 156 | Crossed | D | A |
| 11 | 6 | — | — | Failed | D | C |

The samples Nos. 1 to 10 differ in minimum cross-sectional area of the orifices 32. The sample No. 11 has the orifices 32 with a uniform minimum cross-sectional area.

In the samples Nos. 1 to 8 and 10, the number obtained by subtracting "the sum of the number of one or more largest orifices 37 and the number of large orifices 38" from "the sum of the number of small orifices 39 and the number of one or more smallest orifices 40" is a positive number. In other words, in the samples Nos. 1 to 8 and 10, "the sum of the number of one or more largest orifices 37 and the number of large orifices 38" is smaller than "the sum of the number of small orifices 39 and the number of one or more smallest orifices 40". In sample No. 9, "the sum of the number of one or more largest orifices 37 and the number of large orifices 38" is equal to "the sum of the number of small orifices 39 and the number of one or more smallest orifices 40".

In the samples Nos. 1 to 4 and 10, all the orifices 32 and the straight lines 42 cross each other in the projection 41. In the samples Nos. 5 to 9 and 11, at least one orifice 32 fails to cross any of the straight lines 42 in the projection 41.

(Test 1)

Test 1 relates to pre-ignition. A tester attached each sample to a corresponding cylinder of a natural intake four-cylinder gasoline engine with a 1.3-litter displacement, and operated the engine to move an intake throttle valve to a full throttle position. The engine was operated for one minute to reach a specific ignition timing to check whether pre-ignition occurs. When no pre-ignition occurs, the engine was operated for one minute with spark advance by 2 degrees, and this operation was repeated until pre-ignition occurs.

A larger crank angle at which pre-ignition occurs indicates that pre-ignition is difficult to occur. A sample where a crank angle at which pre-ignition occurs is larger than or equal to 30° in front of the top dead center is evaluated as A (excellent), whereas a sample where a crank angle at which pre-ignition occurs is smaller than 30° in front of the top dead center is evaluated as D (poor). The results are shown in Table 1.

(Test 2)

Test 2 is a test relating to combustion stability. A tester attached each sample to a corresponding cylinder of a supercharged four-cylinder direct-injection gasoline engine with a 1.6-litter displacement, operated the engine, and calculated a coefficient of variance (COV) of an indicated mean effective pressure between 3000 cycles under the conditions of an engine speed of 2000 rpm, a pressure of 1200 kPa, and an air-fuel ratio of 14.5.

A smaller COV indicates higher combustion stability. The sample with a COV of smaller than 1% is evaluated as A (excellent), the sample with a COV of larger than or equal to 1% and smaller than 2% is evaluated as B (good), the sample with a COV of larger than or equal to 2% and smaller than 3% is evaluated as C (fair), and the sample with a COV of larger than or equal to 3% is evaluated as D (poor). The results are shown in Table 1.

(Evaluation)

In Test 1 (pre-ignition), the samples Nos. 1 to 9 were evaluated as A, whereas the samples Nos. 10 and 11 were evaluated as D. The samples Nos. 1 to 9 have the front end portion 15 with a length smaller than or equal to 12 mm, and the orifices 32 vary in minimum cross-sectional area. Compared to the samples Nos. 10 and 11, the samples Nos. 1 to 9 have enhanced fluidity of the fuel gas in the pre-chamber 31, and thus can cool the front end portion 15 with a relatively small heat capacity. This is assumed as the reason why overheating of the front end portion 15 was reduced to reduce pre-ignition.

In Test 2 (combustion stability), the samples Nos. 1 to 8 were evaluated as A, B, or C, whereas the sample No. 9 was evaluated as D. In the samples Nos. 1 to 8, "the sum of the number of one or more largest orifices 37 and the number of large orifices 38" was smaller than "the sum of the number of small orifices 39 and the number of one or more smallest orifices 40". Compared to the sample No. 9, in the samples Nos. 1 to 8, a gas flow including a flame was injected through the orifices 32 other than the largest orifice 37 and the large orifices 38 (through the small orifices 39 and the smallest orifice 40). This structure can stably ignite fuel gas in the combustion chamber. This is assumed as the reason why the combustion stability is improved.

In Test 2, the samples Nos. 1 to 6 were evaluated as A or B, whereas the samples Nos. 7 and 8 were evaluated as C. In the samples Nos. 1 to 6, the rate of the minimum cross-sectional area of the largest orifice 37 to the minimum cross-sectional area of the smallest orifice 40 was within a range of larger than or equal to 120% and smaller than or equal to 500%. Compared to the samples Nos. 7 and 8, in the samples Nos. 1 to 6, the flow of fuel gas in the pre-chamber 31 is enhanced, and fresh fuel gas can more easily reach the spark gap. Thus, the ignition stability improves, and the injection of a gas flow through the smallest orifice 40 can be secured. This is assumed as the reason why combustion stability is further improved.

In Test 2, the samples Nos. 1 to 4 were evaluated as A, whereas the samples Nos. 5 and 6 were evaluated as B. In the samples Nos. 1 to 4, all the orifices 32 and the straight lines 42 cross each other in the projection 41. Compared to the samples Nos. 5 and 6, in the samples Nos. 1 to 4, heat transfer resulting from passage of the fuel gas or injected flow through the orifices 32 is equalized around the axial line of the cap 30. The heat load around the axial line of the cap 30 is substantially equalized. This is assumed as the reason why combustion stability is further improved.

Although the present invention has been described above with reference to the embodiments, the present invention is not limited to the above embodiments, and can be easily understood as being improved or modified in various manners within a range not departing from the gist of the present invention.

Each embodiment has described a case where the cap 30 has eight orifices 32, but this is not limitative. The number of orifices 32 formed in the cap 30 may be determined as appropriate, as long as the number is three or more (at least one largest orifice 37 and two small orifices 39). When the cap 30 has three orifices 32, the orifices 32 include no large orifice 38, and a smaller one of the small orifices 39 serves as a smallest orifice. When the two small orifices 39 have the same size, the minimum cross-sectional area of the smallest orifice is equal to the minimum cross-sectional area of the other small orifice 39.

The embodiment has described a case where the orifices 32 in the cap 30 have a circular cross section, but this is not limitative. Examples of other cross sections of the orifices 32 include an ellipse, a polygon, and a polygon with rounded corners.

The embodiment has described a case where the hemispherical cap 30 including the spherical-crown-shaped inner surface 33 and the outer surface 34 is disposed on the metal shell 21, but this is not limitative. The cap 30 may have any shape as appropriate. For example, a closed-end cylindrical cap may be naturally usable.

The embodiment has described a case where the cap 30 has one largest orifice 37 and one smallest orifice 40, but this is not limitative. When the cap 30 includes multiple orifices with the largest minimum cross-sectional area, the cap 30 includes multiple largest orifices 37. When the cap 30 includes multiple orifices with the smallest minimum cross-sectional area, the cap includes multiple smallest orifices 40.

The embodiment has described a case where the packing 17 (separate member) is interposed between the locking portion 13 of the insulator 11 and the ledge 24 of the metal shell 21, but this is not limitative. The metal shell 21 may naturally be disposed on the outer periphery of the insulator 11 while the locking portion 13 of the insulator 11 and the ledge 24 of the metal shell 21 are directly in contact with each other. In this case, the front end portion 15 refers to the portion of the insulator 11 closer to the front end beyond the portion with which the ledge 24 is in contact.

The embodiment has described a case where the linear ground electrode 25 is disposed at the external thread 23 of the metal shell 21, but this is not limitative. The ground electrode 25 may be disposed on either the metal shell 21 or the cap 30. The shape of the ground electrode 25 is not limited to the linear shape. The ground electrode 25 may be bent. The spark gap is not limited to be located at the tip end side of the center electrode 19. The spark gap may be disposed on the outer side of the center electrode 19 in the radial direction.

The embodiment has described a case where the cap 30 is welded to the metal shell 21, but this is not limitative. It is naturally possible to prepare a tubular member including a cap at the front end, and connect the tubular member to the metal shell 21 to define the pre-chamber 31. The tubular member is a tubular member with the front end closed with the cap, and includes, on the inner peripheral surface, an internal thread to be coupled to the external thread 23 of the metal shell 21. An external thread to be coupled with the threaded hole of an engine is disposed on the outer peripheral surface of the tubular member. When the internal thread of the tubular member is coupled with the external thread 23 of the metal shell 21, the cap is disposed at the front end side of the metal shell 21. This cap has the orifices 32.

Means for connecting the tubular member to the metal shell 21 to dispose a cap at the front end of the metal shell 21 is not limited to means for coupling the internal thread on the inner peripheral surface of the tubular member with the external thread 23 of the metal shell 21. The tubular member may naturally be connected to the metal shell by other means. Examples of other means include means for joining the tubular member and the metal shell by, for example, welding. Examples of the material of the tubular member include metal materials such as nickel alloys or stainless steel and ceramics such as a silicon nitride.

DESCRIPTION OF REFERENCE NUMERALS

10: spark plug
11: insulator
13: locking portion
**14*a***: boundary (front end of the locking portion)
15: front end portion
17: packing (separate member)
18: front end of the insulator
21: metal shell
24: ledge
30: cap
32: orifice
37: largest orifice
38: large orifice
39: small orifice
40: smallest orifice
41: projection
42: straight line
L: length of the front end portion in the axial direction
O: axial line

What is claimed is:

1. A spark plug, comprising:

a tubular metal shell including, on an inner periphery, a ledge protruding inward in a radial direction;

an insulator including a locking portion having a front end side locked onto the ledge directly or with another member interposed therebetween, and a front end portion adjacent to the front end side of the locking portion, the insulator extending along an axial line; and a cap disposed at a front end side of the metal shell to cover a front end side of the front end portion of the insulator, the cap having a plurality of orifices extending through the cap in a thickness direction of the cap, wherein the plurality of orifices include orifices with different minimum cross-sectional areas, wherein, a sum of the number of one or more largest orifices that are included in the plurality of orifices and that have a largest minimum cross-sectional area and the number of one or more large orifices that are included in the plurality of orifices and that have a minimum cross-sectional area of larger than or equal to 90% of the minimum cross-sectional area of the one or more largest orifices is smaller than the number of orifices that are included in the plurality of orifices and that are other than the one or more largest orifices and the one or more large orifices, and wherein a length of the front end portion in an axial direction between a front end of the insulator and a front end of the locking portion is smaller than or equal to 12 mm.

2. The spark plug according to claim 1, wherein a minimum cross-sectional area of each of the plurality of orifices is larger than or equal to 90% of a maximum cross-sectional area of the orifice.

3. The spark plug according to claim 1, wherein a minimum cross-sectional area of the one or more largest orifices is larger than or equal to 120% and smaller than or equal to 500% of a minimum cross-sectional area of one or more smallest orifices that are included in the plurality of orifices and that have a smallest minimum cross-sectional area.

4. The spark plug according to claim 1, wherein the plurality of orifices are formed in an area of the cap excluding a portion that the axial line crosses.

5. The spark plug according to claim 4, wherein, in a projection obtained by projecting the cap on a plane perpendicular to the axial line, when straight lines equal in number to the orifices are drawn at equal angles through an intersection point of the projection and the axial line, all the orifices and the straight lines cross each other.

* * * * *